US010766283B2

(12) United States Patent
Sato

(10) Patent No.: US 10,766,283 B2
(45) Date of Patent: Sep. 8, 2020

(54) TAPE CARTRIDGE

(71) Applicant: SEIKO EPSON CORPORATION, Tokyo (JP)

(72) Inventor: Daisuke Sato, Azumino (JP)

(73) Assignee: SEIKO EPSON CORPORATION, Tokyo (JP)

( * ) Notice: Subject to any disclaimer, the term of this patent is extended or adjusted under 35 U.S.C. 154(b) by 162 days.

(21) Appl. No.: 15/759,205

(22) PCT Filed: Sep. 15, 2016

(86) PCT No.: PCT/JP2016/004201

§ 371 (c)(1),
(2) Date: Mar. 9, 2018

(87) PCT Pub. No.: WO2017/047083

PCT Pub. Date: Mar. 23, 2017

(65) Prior Publication Data

US 2018/0354281 A1 Dec. 13, 2018

(30) Foreign Application Priority Data

Sep. 15, 2015 (JP) ..... 2015-181493
Oct. 8, 2015 (JP) ..... 2015-199984

(51) Int. Cl.
*B41J 15/04* (2006.01)
*B41J 3/407* (2006.01)
(Continued)

(52) U.S. Cl.
CPC ..... *B41J 15/044* (2013.01); *B41J 3/4075* (2013.01); *B41J 15/02* (2013.01); *B41J 15/042* (2013.01);
(Continued)

(58) Field of Classification Search
CPC . B41J 3/4075; B41J 15/02; B41J 15/04; B41J 15/042; B41J 15/044; B41J 32/00;
(Continued)

(56) References Cited

U.S. PATENT DOCUMENTS

2013/0089366 A1 4/2013 Kosuge
2015/0124041 A1 5/2015 Kosuge
2016/0214416 A1 7/2016 Kosuge

FOREIGN PATENT DOCUMENTS

JP 06-227103 * 8/1994 ..... B41J 32/00
JP 07-069497 * 3/1995 ..... B65H 16/06
(Continued)

OTHER PUBLICATIONS

International Search Report issued in related International Patent Application No. PCT/JP2016/004201, completed Oct. 4, 2016.

*Primary Examiner* — Matthew G Marini
*Assistant Examiner* — Marissa Ferguson-Samreth
(74) *Attorney, Agent, or Firm* — Foley & Lardner LLP

(57) ABSTRACT

The tape cartridge including a roll body around which the tape is wound in a roll shape, a cartridge case in which the roll body is accommodated and which is common to the plurality of types of the tape cartridges, a spacer portion that is provided between the cartridge ease and a first end surface which is one end surface of the roll body, and has a varying size in a tape width direction depending on the type of the tape cartridge such that a position of the center of the tape is common to the plurality of types of the tape cartridges in the tape width direction, and an urging member that is provided between the cartridge case and a second end surface which is another end surface of the roll body and urges the roll body and urges the roll body to a first end surface side.

6 Claims, 15 Drawing Sheets

(51) Int. Cl.
*B65H 19/12* (2006.01)
*B41J 15/02* (2006.01)

(52) U.S. Cl.
CPC ..... *B65H 19/12* (2013.01); *B65H 2405/42* (2013.01); *B65H 2801/12* (2013.01)

(58) Field of Classification Search
CPC . B65H 19/12; B65H 2405/42; B65H 2801/12
See application file for complete search history.

(56) References Cited

FOREIGN PATENT DOCUMENTS

| | | | | | |
|---|---|---|---|---|---|
| JP | 11-078189 | A | | 3/1999 | |
| JP | 2002-096515 | | * | 4/2002 | ..... B41J 15/04 |
| JP | 2003-285489 | | * | 10/2003 | ..... B41J 15/04 |
| JP | 2012-006295 | A | | 1/2012 | |

* cited by examiner

TAPE CARTRIDGE

TECHNICAL FIELD

The present invention relates to a tape cartridge which is mounted in a tape printing device.

BACKGROUND ART

In the related art, a tape cassette provided with a coil spring, which upwardly urges a lower reel, between the lower reel and a bottom portion of a case main body is known. In the tape cassette, when an upper reel, which is upwardly urged through the lower reel by the coil spring, is pressed by an upper lid, a back tension is applied to a tape for printing at the time of rewinding the tape for printing (refer to PTL 1).

CITATION LIST

Patent Literature

PTL 1: Japanese Unexamined Patent Application Publication No. 11-078189

SUMMARY OF INVENTION

Technical Problem

The present inventor has found problems as follows.

In a case in which a tape printing device provided with a printing head performs printing on a tape of a tape cartridge mounted in the tape printing device, in order to obtain a result of a uniform printing in a width direction of the tape (hereinafter, refer to as a "tape width direction"), it is preferable that the center of the tape (hereinafter, referred to as a "tape center") be positioned at a predetermined position of the printing head in the tape width direction in a state in which the tape cartridge is mounted. Meanwhile, in a plurality of types of the tape cartridges in which widths of the tapes are different, in order to suppress looseness of the tape inside a cartridge case, it is conceivable that the cartridge case having a varying size depending on the width of the tape is used so as to prevent the generation of a gap between the cartridge case and the tape in the tape width direction as much as possible. When such a tape cartridge is mounted in the tape printing device based on one end portion in the tape width direction, the tape center becomes deviated from a predetermined position of the printing head depending on the types of the tape cartridge, and thus a quality of printing is deteriorated.

An object of the invention is to provide the tape cartridge, which is capable of performing good printing regardless of the types of the tape cartridges, in the plurality of types of the tape cartridges in which widths of the tapes are different.

Solution to Problem

According to the invention, there is provided a tape cartridge of a plurality of types of tape cartridges in which widths of accommodated tapes are different and which is selectively mounted in a common tape printing device, the tape cartridge including a roll body around which the tape is wound in a roll shape, a cartridge case in which the roll body is accommodated and which is common to the plurality of types of the tape cartridges, a spacer portion that is provided between the cartridge case and a first end surface which is one end surface of the roll body, and has a varying size in a tape width direction depending on the type of the tape cartridge such that a position of the center of the tape is common to the plurality of types of the tape cartridges in the tape width direction which is a width direction of the tape, and an urging member that is provided between the cartridge case and a second end surface which is another end surface of the roll body and urges the roll body to a first end surface side.

In this configuration, the urging member presses the roll body with respect to the spacer portion. Therefore, according to the configuration, even in a case in which the cartridge case common to the plurality of types of the tape cartridges is used, looseness of the roll body inside the cartridge case is suppressed. In addition, in the configuration, the cartridge case common to the plurality of types of the tape cartridges is provided. In addition, a position of the tape center is common to the plurality of types of the tape cartridges. Therefore, when the tape cartridge is mounted in the tape printing device, even in any type of the tape cartridge, the tape center is positioned at a predetermined position of the printing head of the tape printing device. Therefore, according to the configuration, in the plurality of types of the tape cartridges in which widths of the tape are different, good printing can be performed regardless of the types of the tape cartridge.

In this case, it is preferable that the urging member include a plate portion in contact with the second end surface and a bendable spring portion.

In this configuration, the spring portion urges the roll body with a surface through the plate portion in contact with the second end surface. Therefore, according to the configuration, it is possible to urge the roll body in good balance without increasing the number of components.

In this case, it is preferable that the cartridge case include a rib which is provided on a wall portion facing the second end surface, the spring portion include a continuous portion which is continuous to the plate portion and a contact portion in contact with the cartridge case, the roll body be rotated when the tape is fed out, and the continuous portion be positioned behind in a rotating direction of the roll body, and the contact portion be positioned ahead in the rotating direction of the roll body.

At the time of feeding out the tape, when the urging member is rotated, sound of the contact portion of the spring portion passed through the rib, which is generated by the contact of the cartridge case, is generated. With respect to that, in this configuration, when the roll body from which the tape is fed out starts to rotate, and the urging member is rotated in accordance with the rotation of the roll body, the contact portion of the spring portion collides to the rib of the cartridge case. Accordingly, after the urging member stops to be rotated, the roll body is rotated while being slidably contact with the stopped urging member. Therefore, according to the configuration, at the time of feeding out the tape, the rotation of the urging member is suppressed, and generation of sound, which is generated by the contact of the contact portion with the cartridge case, is suppressed.

In this case, it is preferable that the urging member include a plurality of the spring portions, and the plurality of spring portions be dispersed in the circumferential direction of the plate portion, and is provided in the plate portion.

According to this configuration, it is possible to urge the roll body by the urging member in good balance.

In this case, it is preferable the wall portion facing the second end surface in the cartridge case and the urging member be translucent.

According to this configuration, an amount of remaining tape of the roll body can be visually recognized through the wall portion facing the second end surface and the urging member.

In this case, it is preferable that the urging member be common to the plurality of types of the tape cartridges.

According to this configuration, since it is unnecessary to prepare a plurality of types of the urging members, it is possible to suppress an increase in cost required for the urging member.

DESCRIPTION OF EMBODIMENTS

Figure 1:
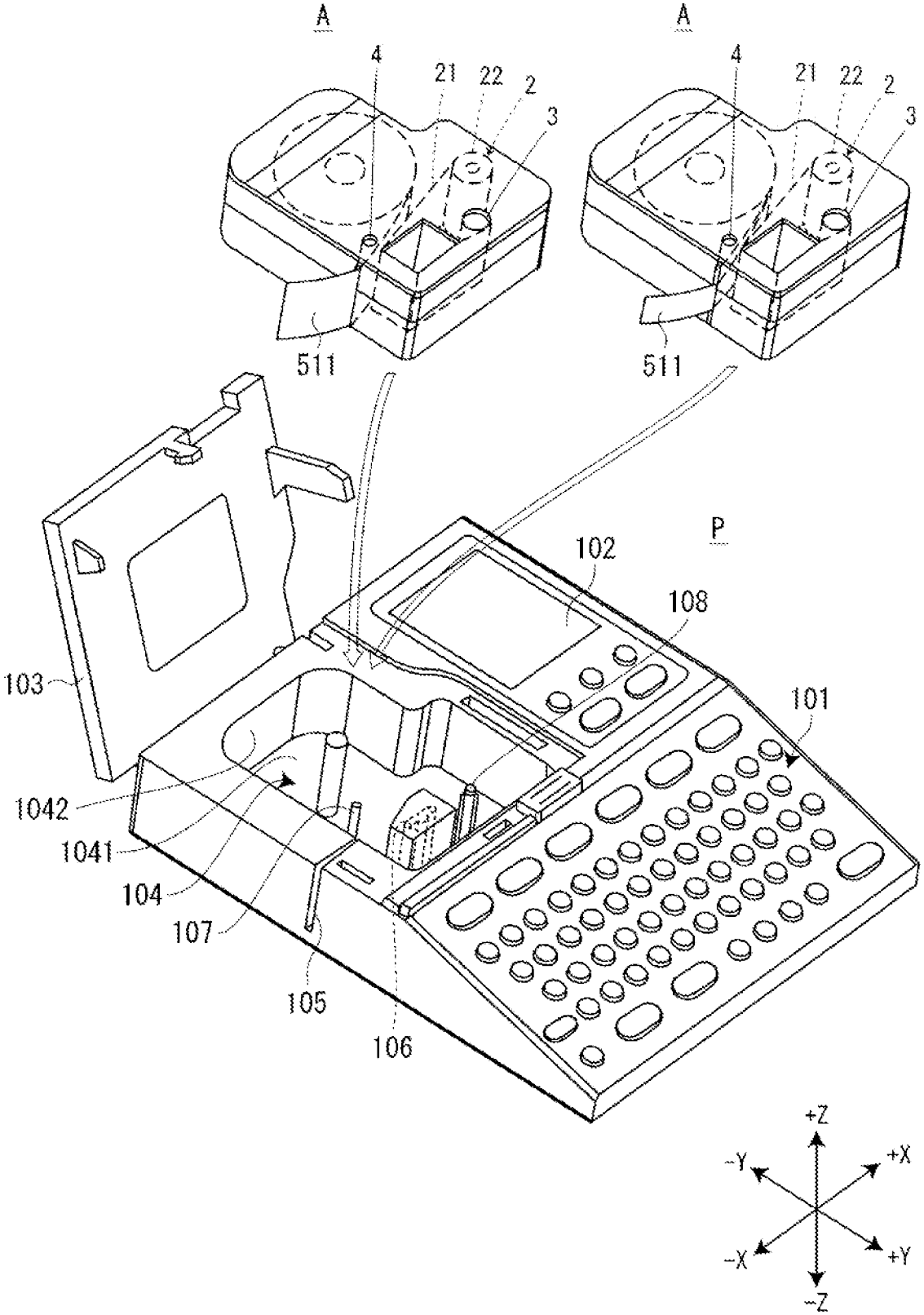
FIG. 1 is a view illustrating two types of a plurality of types of tape cartridges according to an embodiment of the invention, and a tape printing device in which the two types of tape cartridges are selectively mounted.

Hereinafter, a tape cartridge A according to an embodiment of the invention will be described with reference to attached drawings. As the tape cartridge A, a plurality of types of tape cartridges in which widths of tapes 511 are respectively different are prepared, and the plurality of types of the tape cartridges A are selectively mounted in a common tape printing device P. Moreover, in the drawings hereinafter, as needed, in order to clarify an arrangement relationship of each portion such as the tape cartridge A, an XYZ orthogonal coordinate system is illustrated.

With reference to FIG. 1, first, the tape printing device P in which the plurality of types (only two types are illustrated in FIG. 1) of the tape cartridges A are selectively mounted will be described. The tape printing device P is provided with an operating panel 101, a display 102, an openable lid 103, a cartridge mounting portion 104, and a tape discharging opening 105.

The operating panel 101 receives an inputting and editing operation or the like of a character string being printed. The display 102 displays the character string during inputting and editing, various messages, and the like. The openable lid 103 opens and closes the cartridge mounting portion 104. In the cartridge mounting portion 104, the tape cartridge A is detachably mounted in the Z direction. In a state in which the tape cartridge A is mounted in the cartridge mounting portion 104, a width direction of the tape 511 (hereinafter, referred to as a "tape width direction") accommodated in the tape cartridge A is set as the Z direction. The cartridge mounting portion 104 is provided with a mounting bottom wall portion 1041 and a mounting circumferential wall portion 1042. The tape cartridge A is mounted in the cartridge mounting portion 104 so as to be placed in the mounting bottom wall portion 1041. In the mounting bottom wall portion 1041, a printing head 106, a platen driving shaft 107 and a winding driving shaft 108 are provided. In the tape discharging opening 105, the tape 511, on which printing is performed, sent from the tape cartridge A mounted in the cartridge mounting portion 104 is discharged.

Figure 2:
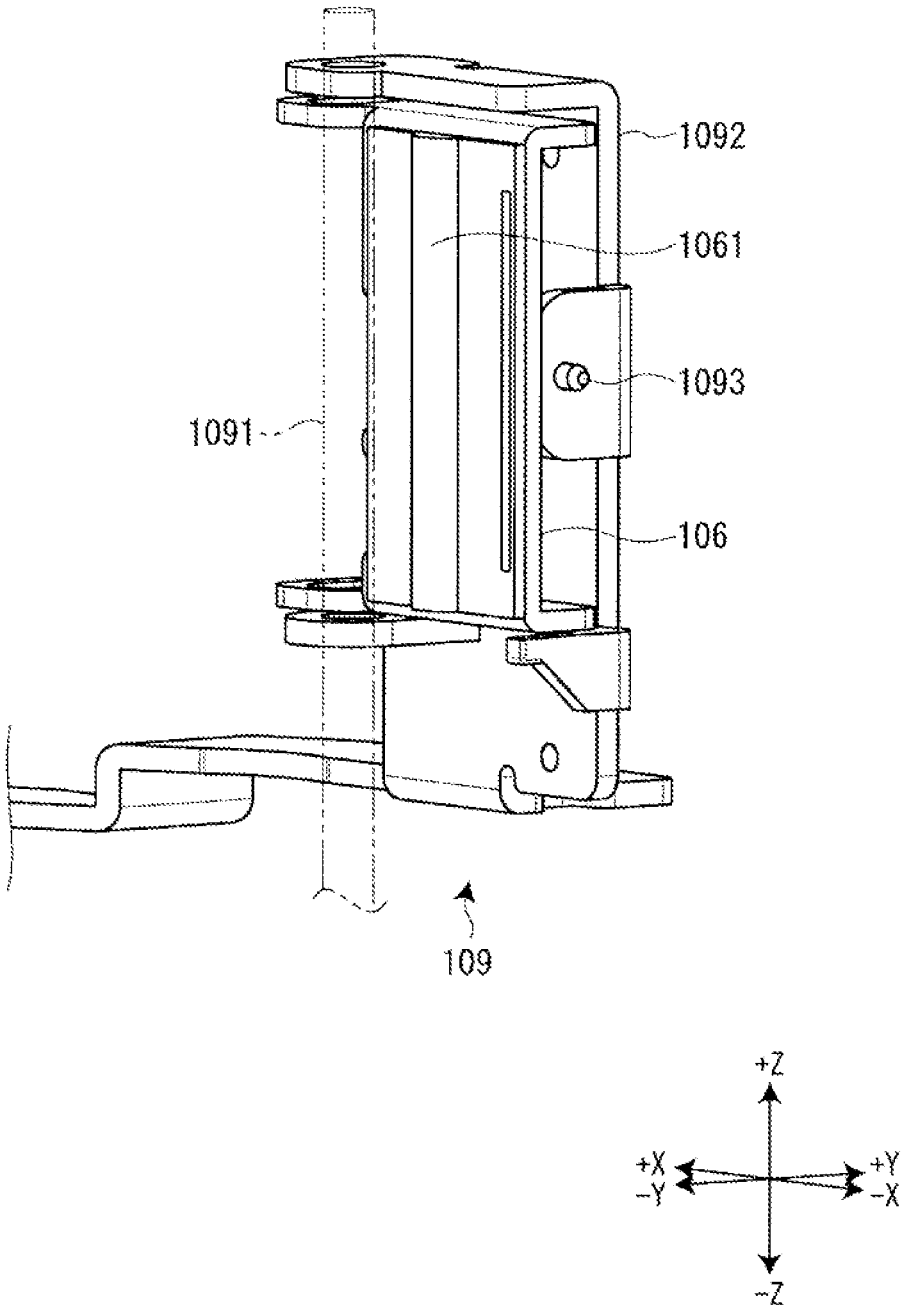
FIG. 2 is a perspective view of a vicinity of a printing head.

With reference to FIG. 2, a head supporting portion 109 which supports the printing head 106 and the printing head 106 will be described.

The printing head 106 is provided with a plurality of heating elements 1061. The heating elements 1061 are arranged on a surface of the printing head 106 in the Z direction, that is, a surface on a −Y side. The head supporting portion 109 is provided with a head supporting shaft 1091, a head supporting frame 1092, and the supporting point pin 1093. In the head supporting shaft 1091, an end portion on a −Z side is fixed to a base frame which is not illustrated and extends in the Z direction. The head supporting frame 1092 is supported by the head supporting shaft 1091 so as to be rotatable, and supports the printing head 106 on the −Y side. The supporting point pin 1093 extends in an X direction. The supporting point pin 1093 connects the printing head 106 to the head supporting frame 1092 so as to be able to be oscillated.

With reference to FIGS. 1 and 2, operations of the printing head 106 in association with the openable lid 103 will be described. When the openable lid 103 opens, the printing head 106 rotates around the head supporting shaft 1091 on a +Y side and evacuates from the platen driving shaft 107 by a head release mechanism (not illustrated) which connects the openable lid 103 to the head supporting frame 1092. Accordingly, when the tape cartridge A is mounted in the cartridge mounting portion 104, the tape 511 and an ink ribbon 21 are inserted between a platen roller 4 and the printing head 106 engaged with the platen driving shaft 107.

Meanwhile, when the openable lid 103 is closed, the printing head 106 rotates around the head supporting shaft 1091 on the −Y side and approaches the platen driving shaft 107 by the head release mechanism. Therefore, when the openable lid 103 is closed in a state in which the tape cartridge A is mounted in the cartridge mounting portion 104, the printing head 106 presses the tape 511 and the ink ribbon 21 to the platen roller 4 engaged with the platen driving shaft 107. At this time, the printing head 106 oscillates with the supporting point pin 1093 as the center. Accordingly, the printing head 106 uniformly presses the tape 511 and the ink ribbon 21 with respect to the platen roller 4 in the Z direction. In this state, when the platen roller 4 is rotated, the tape 511 pinched between the platen roller 4 and the printing head 106 and the ink ribbon 21 are sent. In addition, ink of the ink ribbon 21 is transferred to the tape 511 due to heat applied to the ink ribbon 21 from the printing head 106, and thus printing is performed on the tape 511.

Moreover, a center around which the printing head 106 is oscillated in a tape width direction (Z direction), that is, a position of the supporting point pin 1093 is set as the center (hereinafter, referred to as a "head center") of the printing head 106 in the tape width direction.

Figure 3:
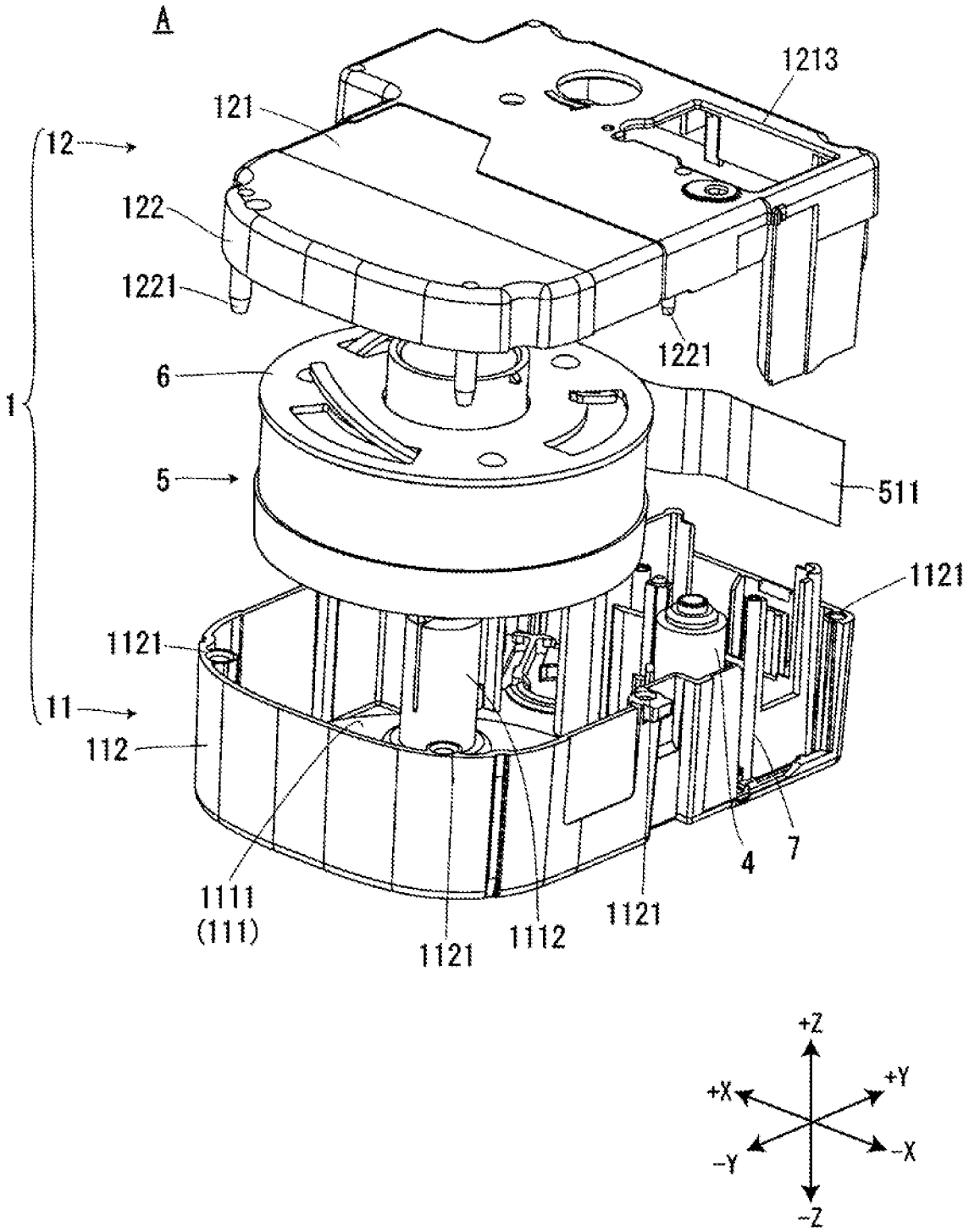
FIG. 3 is a development view of components of the tape cartridge.

With reference to FIG. 3, the tape cartridge A will be described. The tape cartridge A is provided with a cartridge case 1, a ribbon roll 2 (refer to FIG. 1), a ribbon winding core 3 (refer to FIG. 1), the platen roller 4, a tape roll 5, and a spring member 6. As each component except tape roll 5, regardless of the types of the tape cartridge A, that is, regardless of the width of the tape 511, a common component is used.

The cartridge case 1 accommodates the ribbon roll 2, the ribbon winding core 3, the platen roller 4, the tape roll 5, and the spring member 6. A tape delivery outlet 7 is provided on a surface on the −X side of the cartridge case 1. The tape 511 fed out from the tape roll 5 is transported to the outside of the cartridge case 1 from the tape delivery outlet 7. The cartridge case 1 is provided with a first case 11 and a second case 12. The first case 11 and the second case 12 are joined to be able to be separated from each other.

The first case 11 is positioned on a depth side (−Z side) in a mounting direction in a state in which the tape cartridge A is mounted in the cartridge mounting portion 104. The first case 11 is a non-translucent resin molded product. The first case 11 is provided with a first facing wall portion 111 and a first circumferential wall portion 112.

The first facing wall portion 111 faces a second facing wall portion 121 to be described later. When the tape cartridge A is mounted in the cartridge mounting portion 104, the first facing wall portion 111 comes into contact with the mounting bottom wall portion 1041. That is, the tape cartridge A is mounted in the cartridge mounting portion 104 based on the first facing wall portion 111. In a substantially half portion on the −Y side of the first facing wall portion 111, a first tape accommodating area 1111 in a substantially circular shape seen from the +Z side is provided. The tape roll 5 is accommodated in the first tape accommodating area 1111. A core shaft 1112 is provided on the +Z side so as to protrude to a substantially center of the first tape accommodating area 1111. The tape roll 5 is supported by the core shaft 1112 so as to be rotatable. When the platen roller 4 is rotated and the tape 511 is fed out, the tape roll 5 is rotated in a clockwise direction seen from the +Z side. In addition, a first head opening (not illustrated) is provided at the corners on the −X side and the +Y side of the first facing wall portion 111. When the tape cartridge A is mounted in the cartridge mounting portion 104, the printing head 106 is inserted into the first head opening.

The first circumferential wall portion 112 is provided to protrude from a peripheral portion of the first facing wall portion 111 to the +Z side. A plurality of joining holes 1121 are provided on an end surface of the first circumferential wall portion 112.

The second case 12 is positioned on a front side (+Z side) in the mounting direction in a state in which the tape cartridge A is mounted in the cartridge mounting portion 104. The second case 12 is a translucent resin molded product. The second case 12 is provided with the second facing wall portion 121 and a second circumferential wall portion 122.

Figure 4:
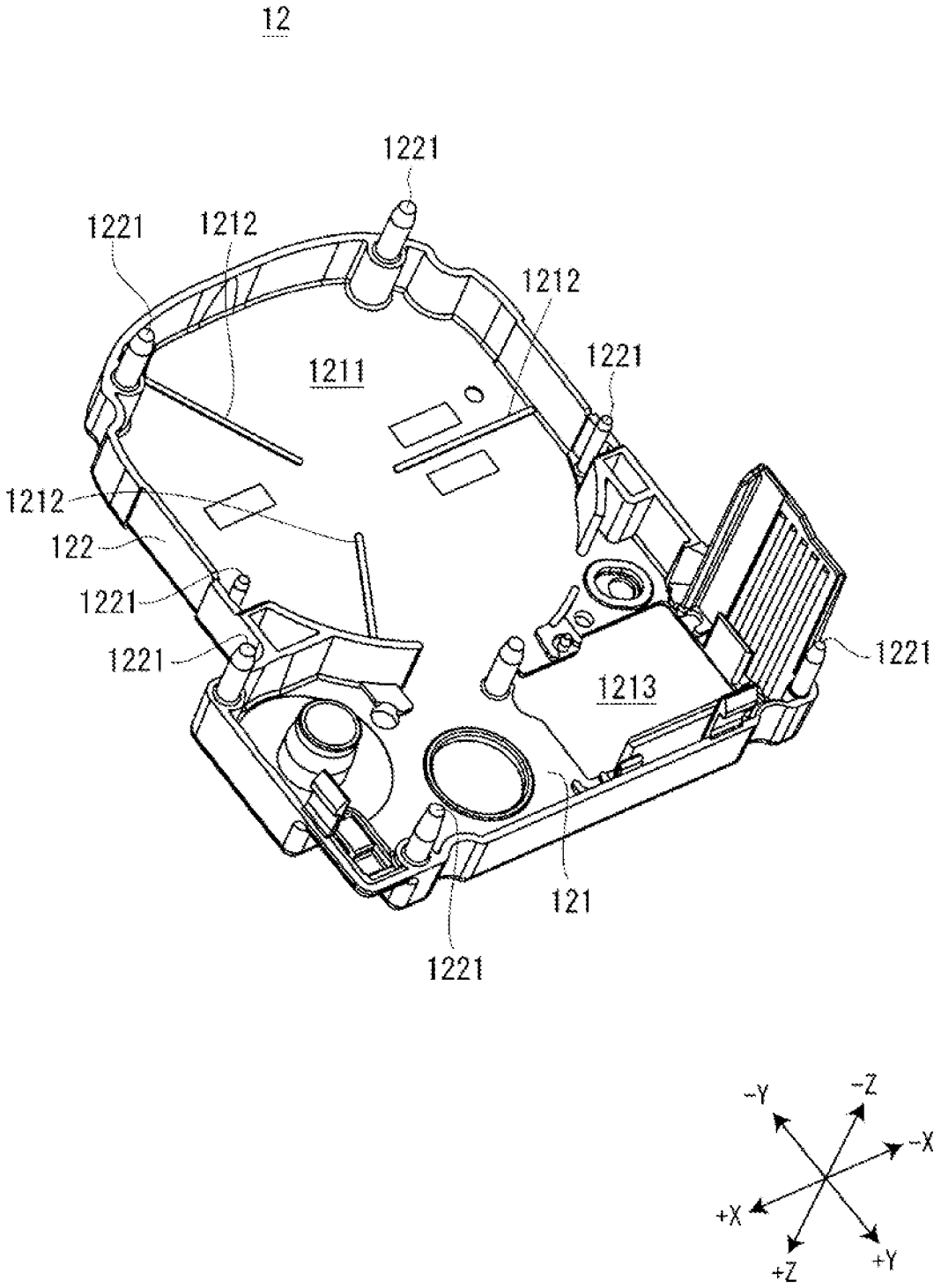
FIG. 4 is a perspective view of a second case.

The second facing wall portion 121 faces the first facing wall portion 111. A second tape accommodating area 1211 in a substantially circular shape seen from the −Z side is provided on a substantially half portion on the −Y side of the second facing wall portion 121, that is, a position corresponding to the first tape accommodating area 1111. The tape roll 5 is accommodated on the second tape accommodating area 1211. A plurality (here, three) of ribs 1212 are provided on the second tape accommodating area 1211 so as to protrude to the −Z side (refer to FIG. 4). The three ribs 1212 radially extend from a substantially center of the second tape accommodating area 1211 at substantially equal angular intervals. In addition, a second head opening 1213 is provided at the corners on the −X side and the +Y side of the second facing wall portion 121. When the tape cartridge A is mounted in the cartridge mounting portion 104, the printing head 106 is inserted into the second head opening 1213.

The second circumferential wall portion 122 is provided to protrude from a peripheral portion of the second facing wall portion 121 to the −Z side. A plurality of joining pins 1221 are provided on an end surface of the second circumferential wall portion 122 so as to protrude to the −Z side. The joining pin 1221 is pressed in the joining hole 1121 provided in the first circumferential wall portion 112, and thus the first case 11 and the second case 12 are joined to each other.

The ribbon roll 2 is provided with the ink ribbon 21 and a ribbon feeding core 22 as illustrated in FIG. 1. The ink ribbon 21 is wound around the ribbon feeding core 22 in a roll shape. The ink ribbon 21 having a width corresponding to a width of the tape 511 having the widest width among the plurality of types of the tape cartridges A is commonly used to the plurality of types of the tape cartridges A. However, the width of the ink ribbon 21 may vary depending on the plurality of types of the tape cartridges A.

The winding driving shaft 108 is engaged with the ribbon winding core 3 in a state in which the tape cartridge A is mounted in the cartridge mounting portion 104. Also, when the winding driving shaft 108 is rotated, the ribbon winding core 3 which is engaged with the winding driving shaft is also rotated. Accordingly, the ink ribbon 21 fed out from the ribbon feeding core 22 is wound around the ribbon winding core 3.

The platen driving shaft 107 is engaged with the platen roller 4 in a state in which the tape cartridge A is mounted in the cartridge mounting portion 104. In this state, the tape 511 and the ink ribbon 21 are pinched between the platen roller 4 and the printing head 106. Also, when the platen driving shaft 107 is rotated, the platen roller 4 which is engaged with the platen driving shaft is also rotated. Accordingly, the tape 511 and the ink ribbon 21 pinched between the platen roller 4 and the printing head 106 are sent.

Figure 5:
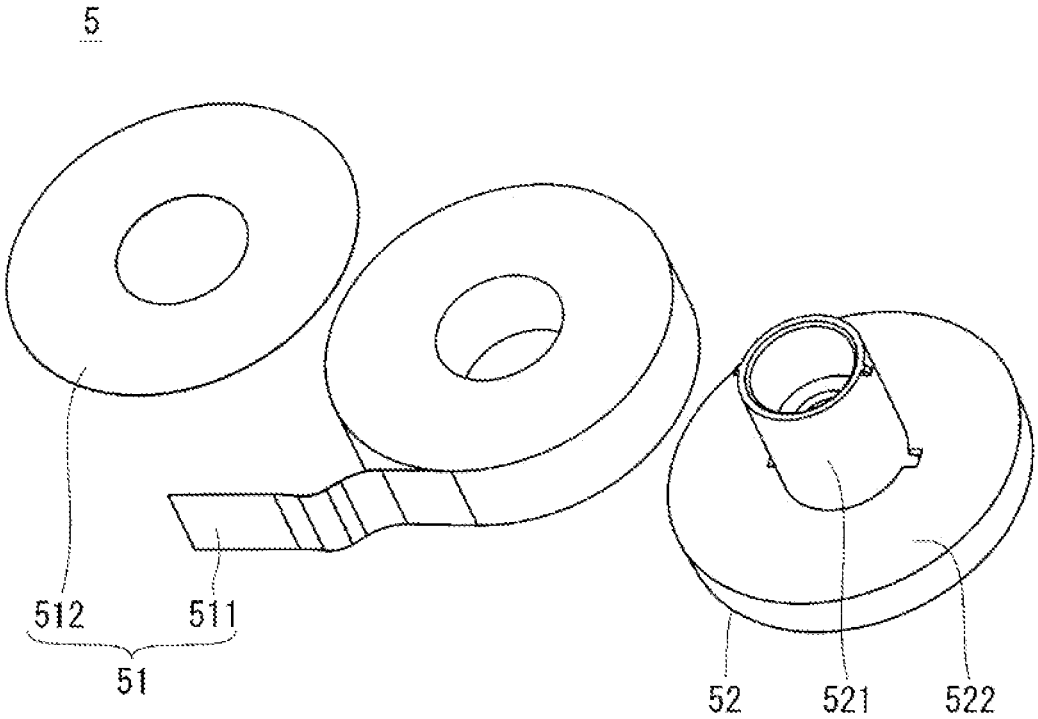
FIG. 5 is a development view of the components of a tape roll.
Figure 5:
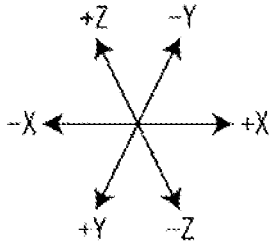

With reference to FIG. 5, the tape roll 5 will be described. The tape roll 5 is provided with a roll body 51 and a tape core 52.

The roll body 51 is provided with the tape 511 and an adhesive film 512. The tape 511 is wound around the tape core 52 in a roll shape. The tape 511 may be, for example, a belt shape, or may be a flat tubular shape (for example, a thermal shrinking tube). The adhesive film 512 is adhered to an end surface on the +Z side of the tape 511 which is wound in a roll shape. That is, the adhesive film 512 constitutes a second end surface 51*b* (refer to FIG. 6) which is an end surface on the +Z side of the roll body 51. The adhesive film 512 is formed in a substantially annular film shape which has a slightly longer outer diameter than that of the roll body 51 in an unused state. When the tape roll 5 is handled in a manufacturing process of the tape cartridge A, looseness of the roll body 51 is suppressed because of the adhesive film 512. Moreover, the adhesive film 512 is translucent.

The tape core 52 is provided with a core portion 521 and a spacer portion 522. The tape 511 is wound in a roll shape in the core portion 521. The core portion 521 is formed in a substantially cylindrical shape with the Z direction as an axis, and the core shaft 1112 is inserted into the core portion 521. The spacer portion 522 is provided in an end portion on the −Z side of the core shaft 1112. That is, the spacer portion 522 is provided between a first end surface 51*a* (with reference to FIG. 6) which is an end surface on the −Z side of the roll body 51 and the first facing wall portion 111. The spacer portion 522 is formed in a substantially annular plate shape in a hollow having a lightly longer outer diameter than that of the roll body 51 in an unused state.

Figure 6:
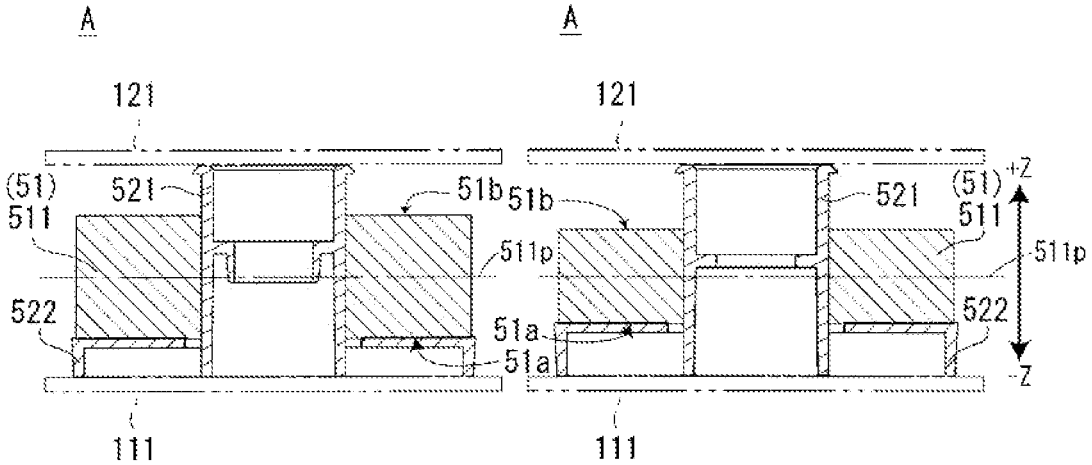
FIG. 6 is a view for describing a relationship of a thickness of a spacer portion and a width of the tape in the tape roll.

With reference to FIG. 6, a relationship of a thickness of the spacer portion 522 and a width of the tape 511 will be described. Regarding the thickness of the spacer portion 522, that is, a size in the tape width direction, a position of the center of the tape 511 (hereinafter, referred to as a "tape center") in the tape width direction is set to be common to the plurality of types of tape cartridges A. Moreover, a dash-dotted line 511*p* indicates the position of the tape center in the Z direction. Therefore, the thin spacer portion 522 is used in the tape cartridge A in which the tape 511 having a wide width is accommodated, and the thick spacer portion 522 is used in the tape cartridge A in which the tape 511 having a narrow width is accommodated. Moreover, the spacer portion 522 may be omitted in the tape cartridge A in which the tape 511 having the widest width is accommodated.

Figure 7:
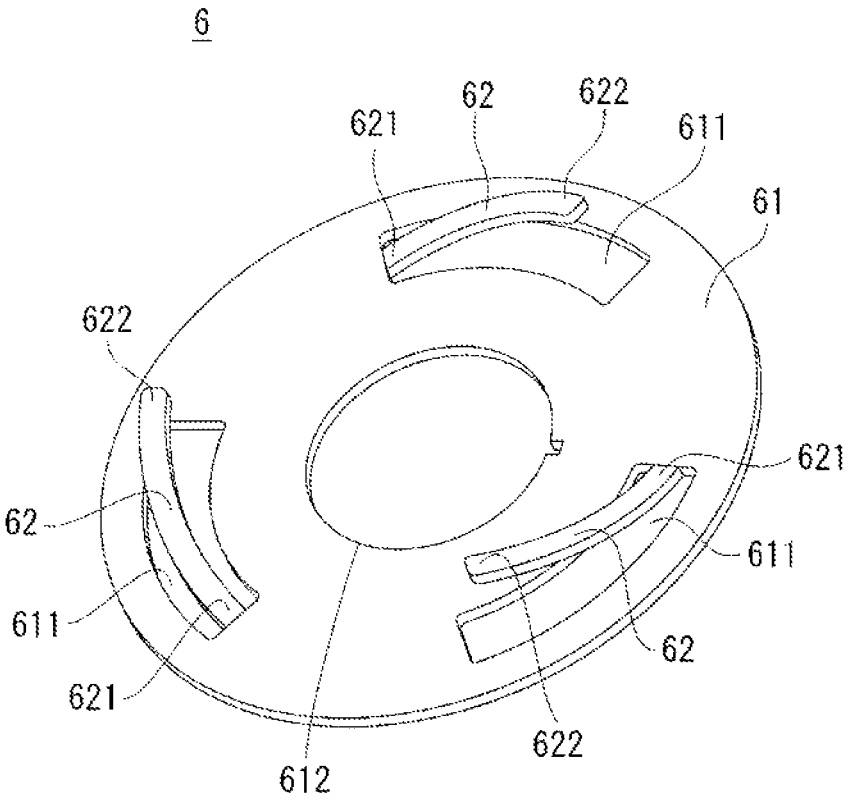
FIG. 7 is a perspective view of a spring member.

With reference to FIG. 7, the spring member 6 will be described. The spring member 6 is provided between the second end surface 51*b* of the roll body 51 and the second facing wall portion 121 facing the second end surface 51*b*. The spring member 6 urges the roll body 51 to the first end surface 51*a* side (−Z side). The spring member 6 is a translucent resin molded product. The spring member 6 is provided with a plate portion 61 and a plurality of (here, three) spring portions 62.

The plate portion 61 is in contact with the second end surface 51*b* of the roll body 51. The plate portion 61 is formed in a substantially thin annular plate shape having a slightly longer outer diameter than that of the roll body 51 in an unused state. In the plate portion 61, an arc shape spring opening 611 which is one size greater than the spring portion 62 seen from the +Z side is provided at a position corresponding to the spring portion 62. In addition, a circular opening 612 is provided at the substantially center of the plate portion 61. The core portion 521 is inserted into the circular opening 612.

The three spring portions 62 are dispersed at equal angular intervals in a circumferential direction of the plate portion 61, and are provided in the plate portion 61. The spring portion 62 is formed in an arc shape seen from the +Z side, and is formed to stand up in an inclined shape on the +Z side from the plate portion 61. A continuous portion 621 corresponding to a base end of the spring portion 62 is connected to the plate portion 61 on one end of the spring opening 611 in a longitudinal direction. In addition, a contact portion 622 corresponding to a distal end of the spring portion 62 is in contact with the second facing wall portion 121. The continuous portion 621 is positioned behind in a clockwise direction, that is, a rear side of the tape roll 5 in rotating direction seen from the +Z side. In addition, the contact portion 622 is positioned ahead in the clockwise direction, that is, ahead the tape roll 5 in a rotating direction seen from the +Z side.

The spring portion 62 is bendable, and an amount of deflection varies depending on being wide and narrow of a gap between the roll body 51 and the second facing wall portion 121. That is, the tape cartridge A in which the tape 511 having a wide width is accommodated has a narrow gap between the roll body 51 and the second facing wall portion 121, and thus the amount of deflection of the spring portion 62 is increased. Meanwhile, in the tape cartridge A in which the tape 511 having a narrow width is accommodated, the gap between the roll body 51 and the second facing wall portion 121 is wide, and thus the amount of deflection of the spring portion 62 is reduced. Therefore, the spring member 6 is capable of urging the roll body 51 regardless of the width of the tape 511.

However, when the tape roll 5, from which the tape 511 is fed out, is rotated, the spring member 6 is also rotated due to friction between the second end surface 51*b* of the roll body 51 and a surface on the −Z side of the plate portion 61 of the spring member 6.

Figure 8:
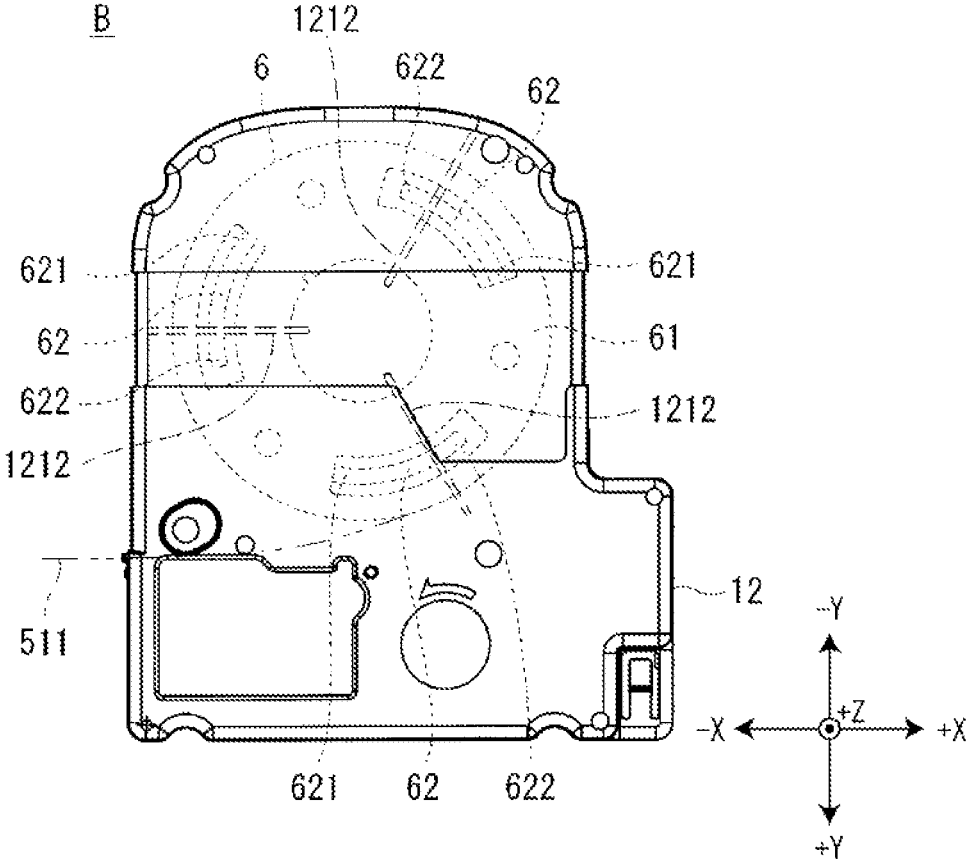
FIG. 8 is a view for describing an aspect of a spring member when a tape is fed out from a roll body in a tape cartridge according to another embodiment different from the tape cartridge illustrated in FIG. 3.
Figure 9:
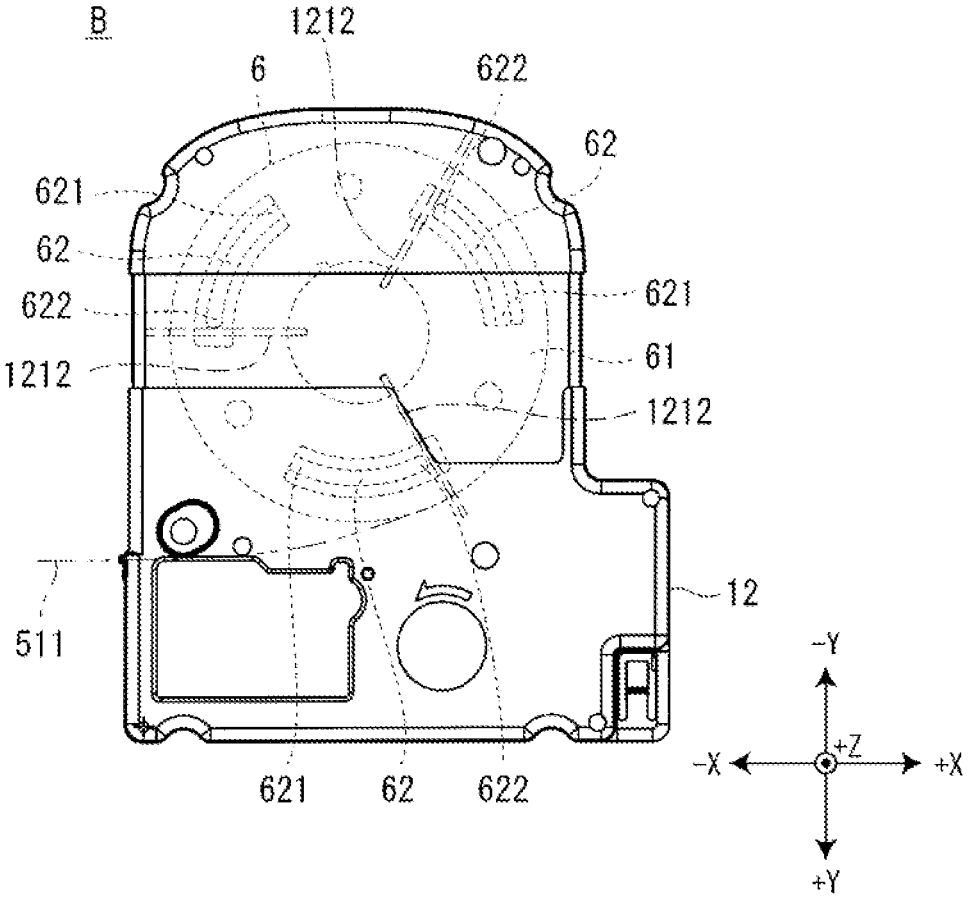
FIG. 9 is a view for describing the aspect of the spring member when the tape is fed out from the roll body in the tape cartridge according to another embodiment different from the tape cartridge illustrated in FIG. 3.

With reference to FIGS. 8 and 9, in the tape cartridge B according to another embodiment different from the tape cartridge A illustrated in FIG. 3, an aspect of the spring member 6 when the tape 511 is fed out from the roll body 51 will be described. The tape cartridge B is configured substantially in the same manner as the tape cartridge A, but it is different from in that the continuous portion 621 of the spring portion 62 is positioned ahead in the rotating direction of the tape roll 5, and the contact portion 622 is positioned behind the tape roll 5 in the spring member 6 in the rotating direction. In this case, during rotating of the tape roll 5, the spring member 6 is also continuously rotated, and the contact portion 622 intermittently generates sound, which is generated by the contact with the cartridge case 1. Because, in this case, when the spring member 6 is rotated, the spring portion 62 is in contact with the rib 1212 at a position between the continuous portion 621 and the contact portion 622, and becomes in a state of being deflected on the −Z side (refer to FIG. 8). It is because, from this state, when the spring member 6 is further rotated, the contact portion 622 passes through the rib 1212, and the contact portion 622 passed through the rib 1212 comes into contact with the second facing wall portion 121 again due to a spring force of the spring portion 62 (refer to FIG. 9).

With respect to that, in the tape cartridge A, during rotating of the tape roll 5, continuously rotating of the spring member 6 is suppressed, and thus generation of sound of the contact portion 622, which is generated by the contact with the cartridge case 1 is suppressed. Hereinafter, with reference to FIGS. 10 and 11, in the tape cartridge A according to the embodiment, an aspect of the spring member 6 at the time of feeding out the tape 511 from the roll body 51 will be described.

Figure 10:
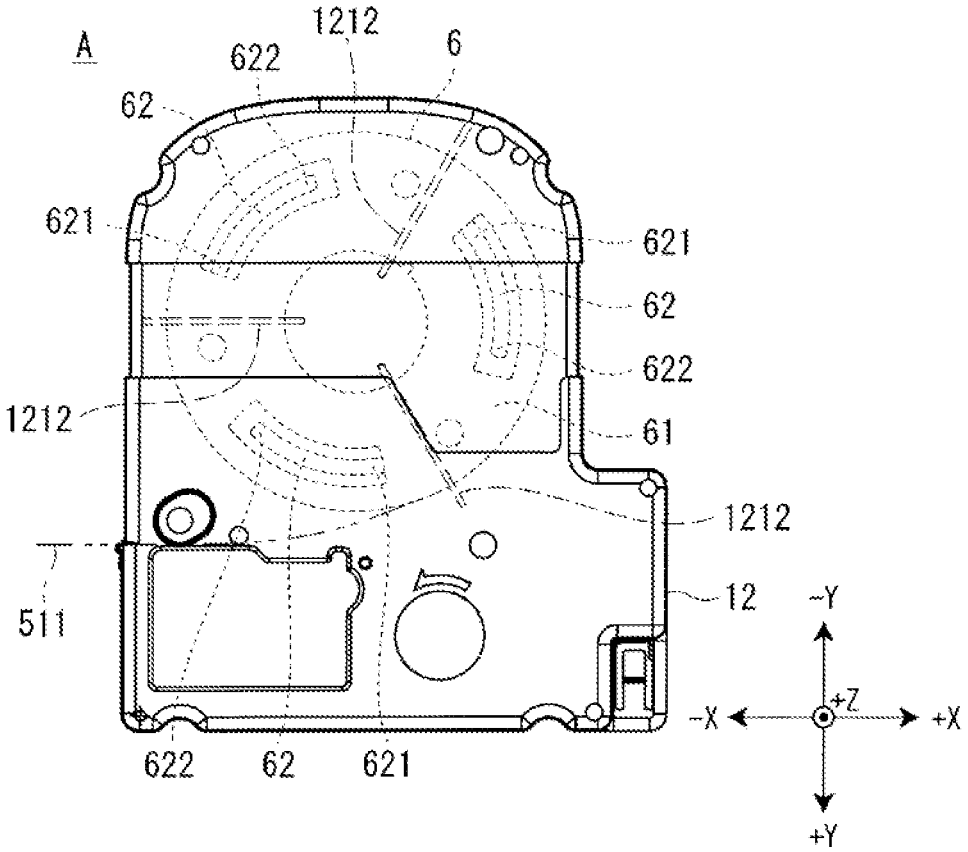
FIG. 10 is a view for describing the aspect of the spring member when the tape is fed out from the roll body in the tape cartridge illustrated in FIG. 3.
Figure 11:
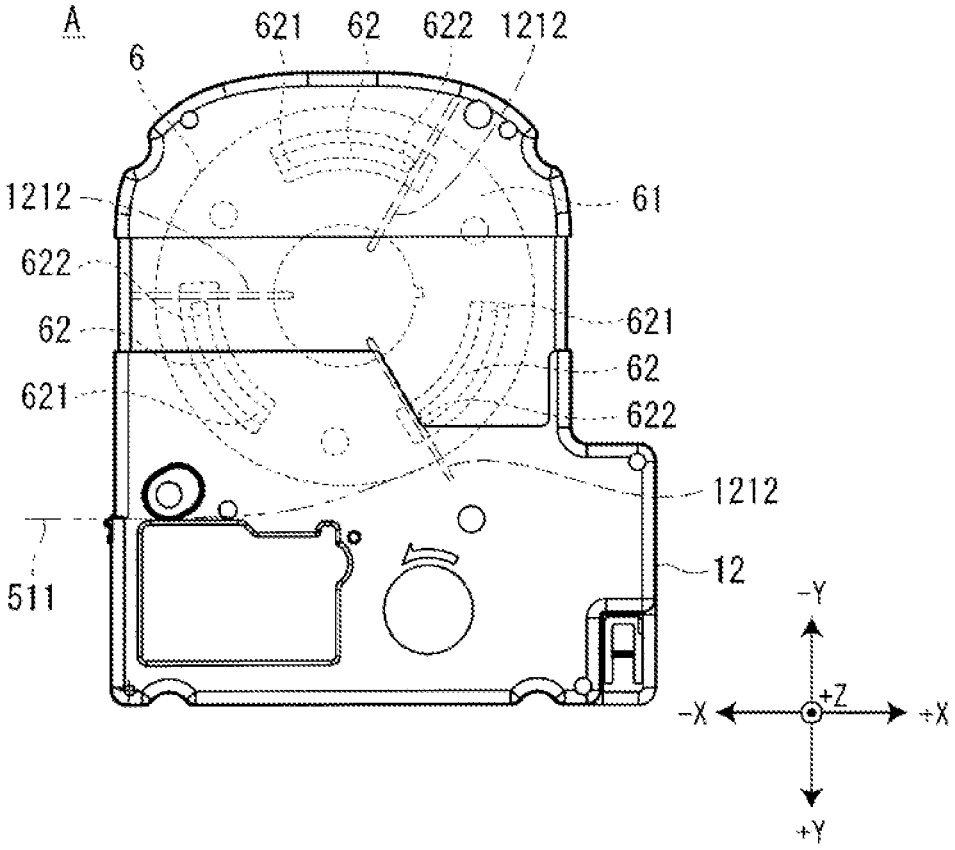
FIG. 11 is a view for describing the aspect of the spring member when the tape is fed out from the roll body in the tape cartridge illustrated in FIG. 3.

FIG. 10 illustrates a state in which the contact portion 622 of the spring portion 62 of the spring member 6 and the rib 1212 of the second case 12 are separated from each other. In this state, when the tape 511 is fed out from the tape roll 5, the tape roll 5 starts to be rotated in a clockwise direction seen from the +Z side, and consequently, the spring member 6 also starts to be rotated in the clockwise direction seen from the +Z side. Here, as described above, in the tape cartridge A of the embodiment, in the spring member 6, the contact portion 622 of the spring portion 62 is positioned ahead in a rotating direction of the tape roll 5, and the continuous portion 621 is positioned behind in the rotating direction of the tape roll 5. Therefore, when the spring member 6 starts to be rotated, as illustrated in FIG. 11, the contact portion 622 of the spring portion 62 abuts to a side surface of the rib 1212 of the second case 12. Accordingly, after the spring member 6 stops to be rotated, the tape roll 5 is rotated while being in slidably contact between the plate portion 61 of the stopped spring member 6 and the tape roll. In this way, generation of the sound of the contact portion 622, which is generated by the contact with the cartridge case 1 is suppressed.

Figure 12:
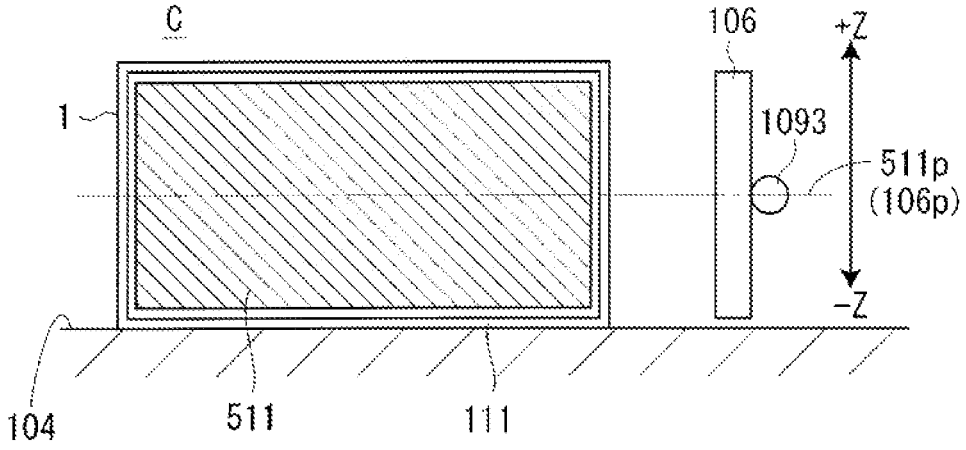
FIG. 12 is a view for describing a position relationship of a tape accommodated in a tape cartridge and a printing head relating to the tape cartridge of a comparative example in which a tape having a wide width is accommodated.
Figure 13:
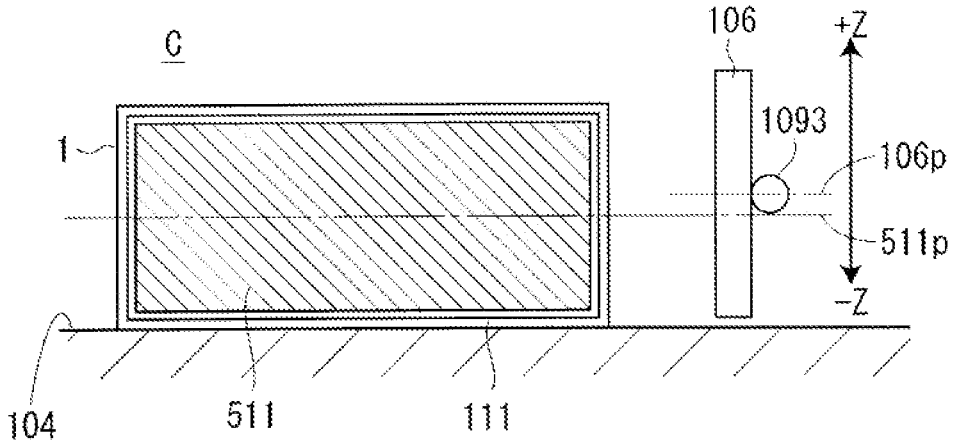
FIG. 13 is a view for describing the position relationship of the tape accommodated in the tape cartridge and the printing head relating to the tape cartridge of the comparative example in which a tape having a narrow width is accommodated.

With reference to FIGS. 12 and 13, a position relationship of the tape 511 and the printing head 106 accommodated in a tape cartridge C according to a comparative example will be described. The tape cartridge C of the comparative example, unlike the tape cartridge A according to the embodiment, is provided with the cartridge case 1 having a varying size in the tape width direction depending on the width of the tape 511 so as to prevent the generation of a gap between the cartridge case 1 and the tape 511 in the tape width direction as much as possible. In addition, in the same manner as that of the tape cartridge A of the embodiment, the tape cartridge C is mounted with reference to the first facing wall portion 111. Therefore, when the tape cartridge C is mounted in the cartridge mounting portion 104, the tape center is deviated from the center of head depending on the types of the tape cartridge C. For example, as illustrated in FIG. 12, in the tape cartridge C in which the tape 511 having a wide width is accommodated, the tape center is positioned at the center of head, but as illustrated in FIG. 13, in the tape cartridge C in which the tape 511 having a narrow width is accommodated, the tape center is deviated from the center of head. Moreover, the dash-dotted line 106*p* illustrated in drawings indicates a position of the center of the head in the Z direction. Also, in the tape cartridge C in which the tape center is deviated from the center of head, the tape 511 is uniformly pressed by the printing head 106 in the tape width direction, a printing quality is deteriorated.

With respect to that, in this embodiment, in the plurality of types of the tape cartridges A in which widths of the tapes 511 are different, good printing can be performed regardless of the types of the tape cartridge A. Hereinafter, with reference to FIGS. 14 and 15, the position relationship of the tape 511 and the printing head 106 accommodated in the tape cartridge A of the embodiment will be described.

Figure 14:
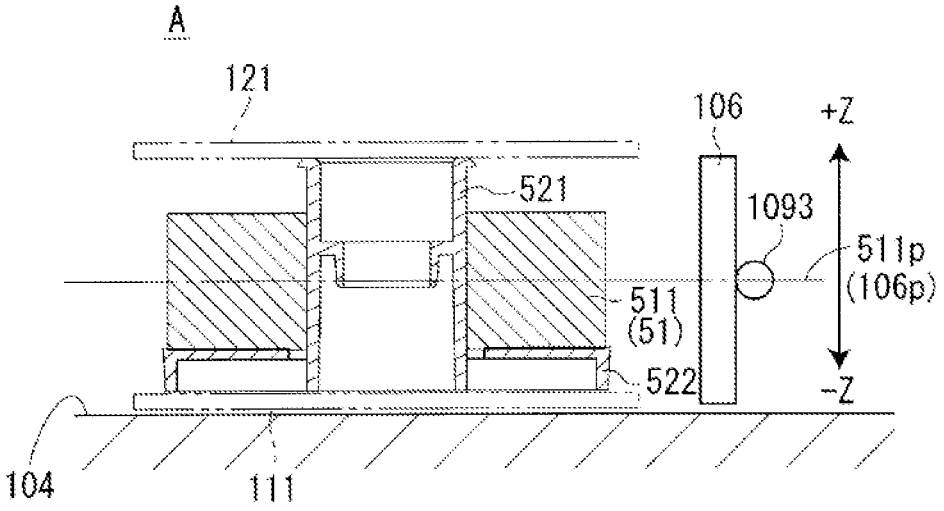
FIG. 14 is a view for describing the position relationship of the tape accommodated in the tape cartridge and the printing head relating to the tape cartridge of the embodiment in which the tape having a wide width is accommodated.
Figure 15:
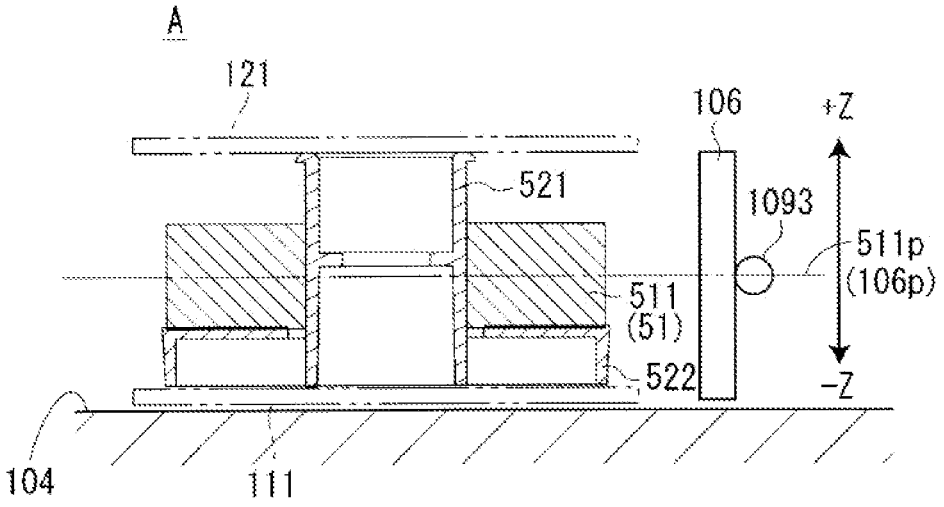
FIG. 15 is a view for describing the position relationship of the tape accommodated in the tape cartridge and the printing head relating to the tape cartridge of the embodiment in which the tape having a narrow width is accommodated.

As illustrated in FIGS. 14 and 15, in the tape cartridge A of the embodiment, as described above, the plurality of types of tape cartridges A in which widths of the tapes 511 are different are provided with the cartridge case 1 common to the plurality of types of tape cartridges A. In addition, a thickness of the spacer portion 522 is different depending on the types of the tape cartridge A, and a position of the tape center is common to the plurality of types of tape cartridges A. Therefore, when the tape cartridge A is mounted in the cartridge mounting portion 104, even in any type of the tape cartridge A, the tape center is positioned at the center of the head. As a result, even in any type of the tape cartridge A, since the tape 511 is uniformly pressed by the printing head 106 in the tape width direction, a good result can be obtained.

As seen from the above, the tape cartridge A of the embodiment in the plurality of types of tape cartridges A in which widths of the tape 511 are different is one of the tape cartridges A among the plurality of types of the tape cartridge A which are selectively mounted in the common tape printing device P. The tape cartridge A is provided with the roll body 51 around which the tape 511 is wound in a roll shape, the cartridge case 1 in which the roll body 51 is accommodated, the spacer portion 522 provided between the cartridge case 1 and the first end surface 51*a* of the roll body 51, and the spring member 6 provided the cartridge case 1 and the second end surface 51*b* of the roll body 51. The cartridge case 1 is common to the plurality of types of the tape cartridges A. The spacer portion 522 has a varying size depending on the type of the tape cartridge A in the tape width direction such that a position of the tape center of the tape 511 is common to the plurality of types of the tape cartridges A in the tape width direction. The spring member 6 urges the roll body 51 to the first end surface 51*a* side.

According to this configuration, as described above, in the plurality of types of the tape cartridges A in which the widths of the tape 511 are different, good printing can be performed regardless of the types of the tape cartridges A.

In addition, in the tape cartridge A of the embodiment, the spring member 6 is provided with the plate portion 61 and the spring portion 62. The plate portion 61 is in contact with the second end surface 51*b* of the roll body 51. The spring portion 62 is provided with the continuous portion 621 which is continuous to the plate portion 61, and the contact portion 622 in contact with the cartridge case 1.

In this configuration, the spring portion 62 urges the roll body 51 with a surface through the plate portion 61 in contact with the second end surface 51*b*. Therefore, according to the configuration, it is possible to urge the roll body 51 in good balance without increasing the number of components.

In addition, in the tape cartridge A of the embodiment, the cartridge case 1 includes the rib 1212 which is provided in the second facing wall portion 121 facing the second end surface 51*b*. The roll body 51 is rotated when the tape 511 is fed out. The continuous portion 621 is positioned behind in the rotating direction of the roll body 51, and the contact portion 622 is positioned ahead in the rotating direction of the roll body 51.

According to this configuration, as described above, when the tape 511 is fed out, rotation of the spring member 6 is suppressed, and generation of the sound of the contact portion 622, which is generated by the contact with the cartridge case 1 is suppressed.

In addition, in the tape cartridge A of the embodiment, the spring member 6 includes a plurality of the spring portions 62, and the plurality of spring portions 62 are dispersed in the circumferential direction of the plate portion 61 and is provided in the plate portion 61.

According to this configuration, it is possible to urge the roll body 51 in good balance by the spring member 6.

In addition, in the tape cartridge A of the embodiment, the second facing wall portion 121 facing the second end surface 51*b* in the cartridge case 1 and the spring member 6 are translucent.

According to this configuration, through the second facing wall portion 121 and the spring member 6, an amount of remaining of the tape 511 in the roll body 51 can be visually recognized.

In addition, in the tape cartridge A of the embodiment, the spring member 6 is common to the plurality of types of the tape cartridges A.

According to this configuration, since it is unnecessary to prepare a plurality of types of the spring member 6, increase in costs required for the spring member 6 can be suppressed.

The invention is not limited to the above-described embodiments, and it is needless to say that various configurations can be adopted without departing from the gist thereof. For example, the embodiment can be modified as follows.

The spring member 6 may be made of materials other than a translucent resin, and for example, a non-translucent resin, a metal such as stainless steel, and the like can be used. Moreover, in a case in which the spring member 6 is non-translucent, it is preferable that an opening be provided at a position deviated from the spring portion 62 in the plate portion 61 in order to be able to confirm the amount of remaining of the tape 511. A shape of the plate portion 61 does not need to be flat, and for example, a shape in which the outer edge portion or an inner edge portion may be reversed toward the second facing wall portion 121 side.

As an urging member, it is not limited to the spring member 6, and for example, an urging member made of an elastic material such as a sponge or a rubber may be used, or a compressing coil spring may be used.

CROSS REFERENCE TO RELATED APPLICATIONS

This application claims priority to Japanese Patent Application No. 2015-181493 filed on Sep. 15, 2015, and No. 2015-199984 filed on Oct. 8, 2015, the entire contents of which are incorporated by reference herein.

The invention claimed is:

1. A tape cartridge of a plurality of types of tape cartridges configured to contain tapes with different widths, the plurality of types of tape cartridges configured to be mounted in a common tape printing device, the tape cartridge comprising:

a roll body around which a tape is wound in a roll shape;

a cartridge case in which the roll body is contained and which is common to the plurality of types of the tape cartridges;

a spacer portion of a plurality of spacer portions that each have different sizes in a tape width direction, wherein the spacer portion is positioned between the cartridge case and a first end surface of the roll body, the spacer portion having a size in the tape width direction that is selected from the plurality of spacer portions depending on the width of the tape such that a position of the center of the tape is the same as the respective positions of the centers of the tapes within the plurality of types of tape cartridges in the tape width direction; and an urging member that is provided between the cartridge case and a second end surface of the roll body and urges the roll body to a first end surface side.

2. The tape cartridge according to claim 1, wherein the urging member includes a bendable spring portion and a plate portion in contact with the second end surface of the roll body.

3. The tape cartridge according to claim 2, wherein the cartridge case includes a rib which is provided on a wall portion facing the second end surface, wherein the spring portion includes a continuous portion which is continuous to the plate portion, and a contact portion in contact with the cartridge case, wherein the roll body is rotated when the tape is fed out, and wherein the continuous portion is positioned behind in a rotating direction of the roll body, and the contact portion is positioned ahead in the rotating direction of the roll body.

4. The tape cartridge according to claim 2, wherein the urging member includes a plurality of the spring portions, and wherein the plurality of spring portions are dispersed in the circumferential direction of the plate portion, and are provided in the plate portion.

5. The tape cartridge according to claim 1, wherein the wall portion facing the second end surface in the cartridge case and the urging member are translucent.

6. The tape cartridge according to claim 1, wherein the urging member of each of the plurality of types of tape cartridges is the same.

* * * * *